US005452576A

United States Patent [19]

Hamburg et al.

[11] Patent Number: 5,452,576

[45] Date of Patent: Sep. 26, 1995

[54] AIR/FUEL CONTROL WITH ON-BOARD EMISSION MEASUREMENT

[75] Inventors: Douglas R. Hamburg, Bloomfield; Jeffrey A. Cook, Dearborn; Richard E. Soltis, Redford; Eleftherios M. Logothetis, Birmingham; Jacobus H. Visser, Southfield, all of Mich.

[73] Assignee: Ford Motor Company, Dearborn, Mich.

[21] Appl. No.: 288,093

[22] Filed: Aug. 9, 1994

[51] Int. Cl.[6] ..... F01N 3/20

[52] U.S. Cl. ..... 60/274; 60/276; 60/285

[58] Field of Search ..... 60/274, 276, 285

[56] References Cited

U.S. PATENT DOCUMENTS

| | | |
|---|---|---|
| 4,194,471 | 3/1980 | Baresel . |
| 4,789,939 | 12/1988 | Hamburg . |
| 4,878,473 | 11/1989 | Nakaniwa et al. . |
| 4,915,080 | 4/1990 | Nakaniwa et al. . |
| 4,988,429 | 1/1991 | Iwakiri et al. . |
| 5,259,189 | 11/1993 | Baier et al. . |
| 5,325,764 | 7/1994 | Hamburg ..... 60/285 |

FOREIGN PATENT DOCUMENTS 2-125941A 5/1990 Japan .

*Primary Examiner*—Douglas Hart
*Attorney, Agent, or Firm*—Allan J. Lippa; Roger L. May

[57] ABSTRACT

An engine air/fuel control system (8) and method for controlling an engine (28) coupled to a catalytic converter (50) and for providing a measurement of engine emissions (202–296). Nitrogen oxides concentration, hydrocarbon concentration, and carbon monoxide concentration of exhaust gases downstream of the converter are measured (46, 54, and 52). Each concentration measurement is averaged for the speed load cell in which such measurement occurred (244–256). Each concentration average measurement is converted to a measurement of mass emissions emitted during a test cycle (268–284). Fuel delivered to the engine is corrected by a feedback variable (104–134, 158–178) derived from both an exhaust gas oxygen sensor (44) positioned upstream of the converter and the three sensors positioned downstream of the converter (46, 52, 54). A measurement of emissions in response to the averaged mass measurements of emission concentration downstream of the converter is also provided (278–296).

20 Claims, 8 Drawing Sheets

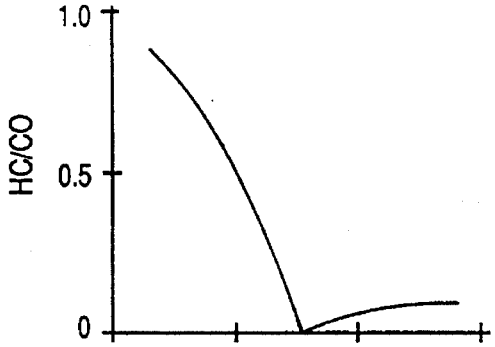
FIG.3A
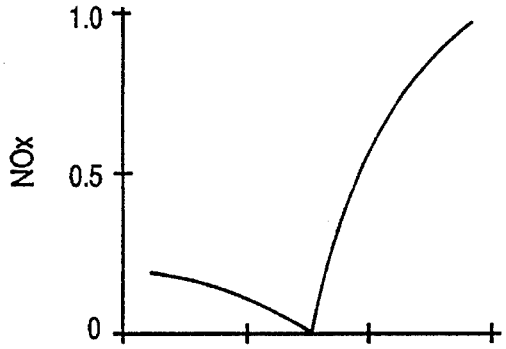
FIG.3B
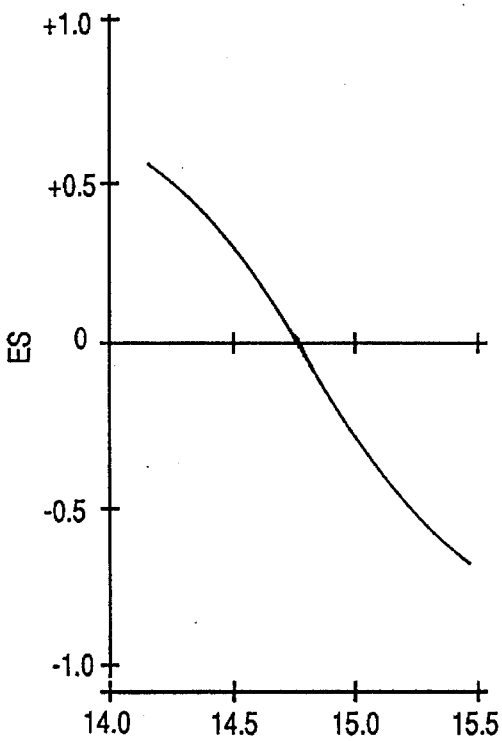
FIG.3C
FIG.3D

AIR/FUEL CONTROL WITH ON-BOARD EMISSION MEASUREMENT

BACKGROUND OF THE INVENTION

The field of the invention relates to air/fuel control systems. In one particular aspect of the invention, the field relates to monitoring emissions of an internal combustion engine while controlled under an air/fuel control system.

U.S. Pat. No. 5,259,189 discloses an engine air/fuel control system responsive to a feedback variable derived from an exhaust gas oxygen sensor positioned upstream of a catalytic converter. The catalytic converter is monitored by a hydrogen and/or carbon monoxide sensor positioned downstream of the converter. An indication of converter failure is provided when the sensor output exceeds a specified threshold value.

The inventors herein have recognized numerous problems and disadvantages with the above approach. For example, use of a hydrogen and/or carbon monoxide sensor appears to have the limitation of detecting converter degradation only when rich excursions in the engine air/fuel ratio occur and not when lean excursions occur. The inventors herein recognize that detection of lean excursions requires a nitrogen oxide sensor. Another problem of the above approach appears to be that transient operation under high engine load conditions may result in an erroneous indication of converter failure.

SUMMARY OF THE INVENTION

An object of the invention herein is to provide on-board measurement of the total mass of emissions during a test cycle which occurs while the engine is operated under air/fuel feedback control.

The above object is achieved, and disadvantages of prior approaches overcome, by providing both an air/fuel control system and method for controlling an engine coupled to a catalytic converter and for providing a measurement of engine emissions. In one particular aspect of the invention, the method comprises the steps of: measuring nitrogen oxide concentration of exhaust gases downstream of the converter; converting the nitrogen oxide concentration measurement to a measurement of mass of nitrogen oxide emitted to generate a first measurement signal; measuring hydrocarbon concentration of exhaust gases downstream of the converter; converting the hydrocarbon concentration measurement to a measurement of mass of hydrocarbon emitted to generate a second measurement signal; and correcting fuel delivered to the engine by a feedback variable derived from both the first measurement signal and the second measurement signal to maintain the engine air/fuel ratio at optimal converter efficiency and providing a measurement of emissions in response to the first measurement signal and the second measurement signal.

Preferably, the step of converting nitrogen oxide concentration to nitrogen oxide mass is responsive to a measurement of mass airflow inducted into the engine. And, preferably, the above method further comprises a step of measuring carbon monoxide concentration of exhaust gases downstream of the converter to generate a third measurement signal and the step of providing a measurement of emissions is further responsive to the third measurement signal.

An advantage of the above aspect of the invention is that the actual mass of emissions is accurately measured over a test cycle while the engine is being operated under air/fuel feedback control. An accurate indication of how the engine air/fuel control system, exhaust gas oxygen sensors, other emission sensors, and catalytic converter are operating is provided. Another aspect of the invention is that an accurate measurement of emissions is provided regardless of whether the engine is operating lean or rich of the catalytic converter's efficiency window.

BRIEF DESCRIPTION OF THE DRAWINGS

The above objects and advantages are achieved, and disadvantages of prior approaches overcome, by the following exemplary description of a control system which embodies the invention with reference to the following drawings:

FIGS. 3A–3D are electrical waveforms representing the output of a portion of the embodiment shown in FIG. 1;

DESCRIPTION OF THE PREFERRED EMBODIMENT

Figure 1:
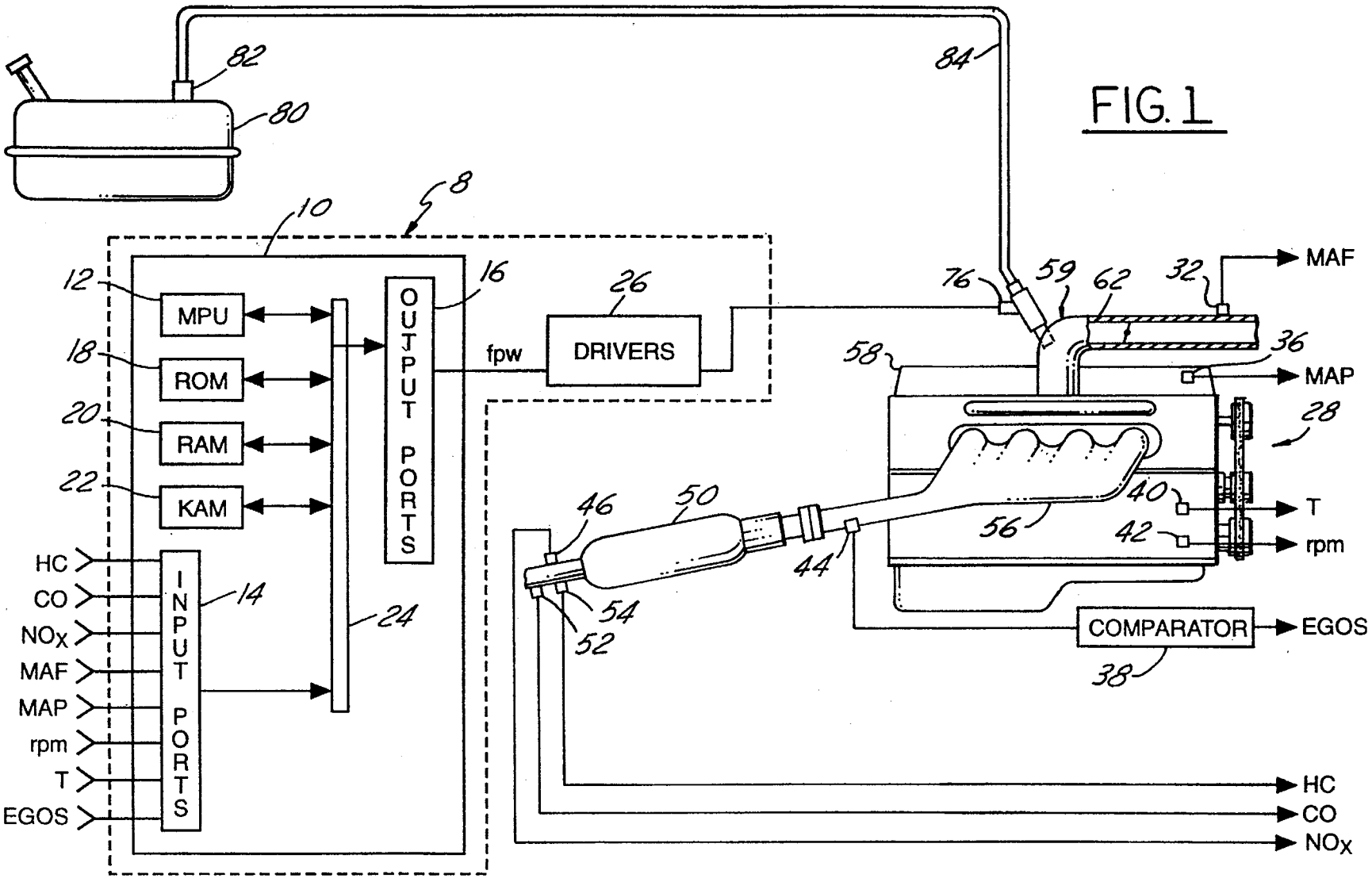
FIG. 1 is a block diagram of an engine and control system in which the invention is used to advantage.

Controller 8 is shown in the block diagram of FIG. 1 as a conventional engine controller having microcomputer 10 which includes: microprocessor unit input ports 14; output ports 16; read-only memory 18, for storing the control program; random access memory 20 for temporary data storage which may also be used for counters or timers; keep-alive memory 22, for storing learned values; and conventional data bus 24. Controller 8 also includes electronic drivers 26 and other conventional engine controls well-known to those skilled in the art such as exhaust gas recirculation control and ignition control.

Various signals from sensors coupled to engine 28 are shown received by controller 8 including; measurement of inducted mass airflow (MAF) from mass airflow sensor 32; manifold pressure (MAP), commonly used as an indication of engine load, from pressure sensor 36; engine coolant temperature (T) from temperature sensor 40; indication of engine speed (rpm) from tachometer 42; an indication of concentration of nitrogen oxides (NOx) in the engine exhaust from nitrogen oxides sensor 46; an indication of carbon monoxide concentration (CO) from sensor 52; and an indication of hydrocarbon concentration (HC) from sensor 54. Sensors 46, 52, and 54 are shown positioned in the engine exhaust downstream of catalytic converter 50.

In this particular example, sensors 46, 52, and 54 are catalytic-type sensors sold by Sonoxco Inc. of Mountain View, Calif. The invention may also be used to advantage with combined measurements of HC and CO by a single sensor.

Controller 8 receives two-state (rich/lean) signal EGOS from comparator 38 resulting from a comparison of exhaust gas oxygen sensor 44, positioned upstream of catalytic converter 50, to a reference value. In this particular example, signal EGOS is a positive predetermined voltage such as one volt when the output of exhaust gas oxygen sensor 44 is greater than the reference value and a predetermined negative voltage when the output of sensor 44 switches to a value less than the reference value. Under ideal conditions, with an ideal sensor and exhaust gases fully equilibrated, signal EGOS will switch states at a value corresponding to stoichiometric combustion. Those skilled in the art will recognize that other sensors may be used to advantage such as proportional exhaust gas oxygen sensors.

Intake manifold 58 of engine 28 is shown coupled to throttle body 59 having primary throttle plate 62 positioned therein. Throttle body 59 is also shown having fuel injector 76 coupled thereto for delivering liquid fuel in proportion to the pulse width of signal fpw from controller 10. Fuel is delivered to fuel injector 76 by a conventional fuel system including fuel tank 80, fuel pump 82, and fuel rail 84.

Although a fuel injected engine is shown in this particular example, the invention claimed later herein may be practiced with other engines such as carbureted engines. It will also be recognized that conventional engine systems are not shown for clarity such as an ignition system (typically including a coil, distributor, and spark plugs), an exhaust gas recirculation system, fuel vapor recovery system and so on.

Figure 2:
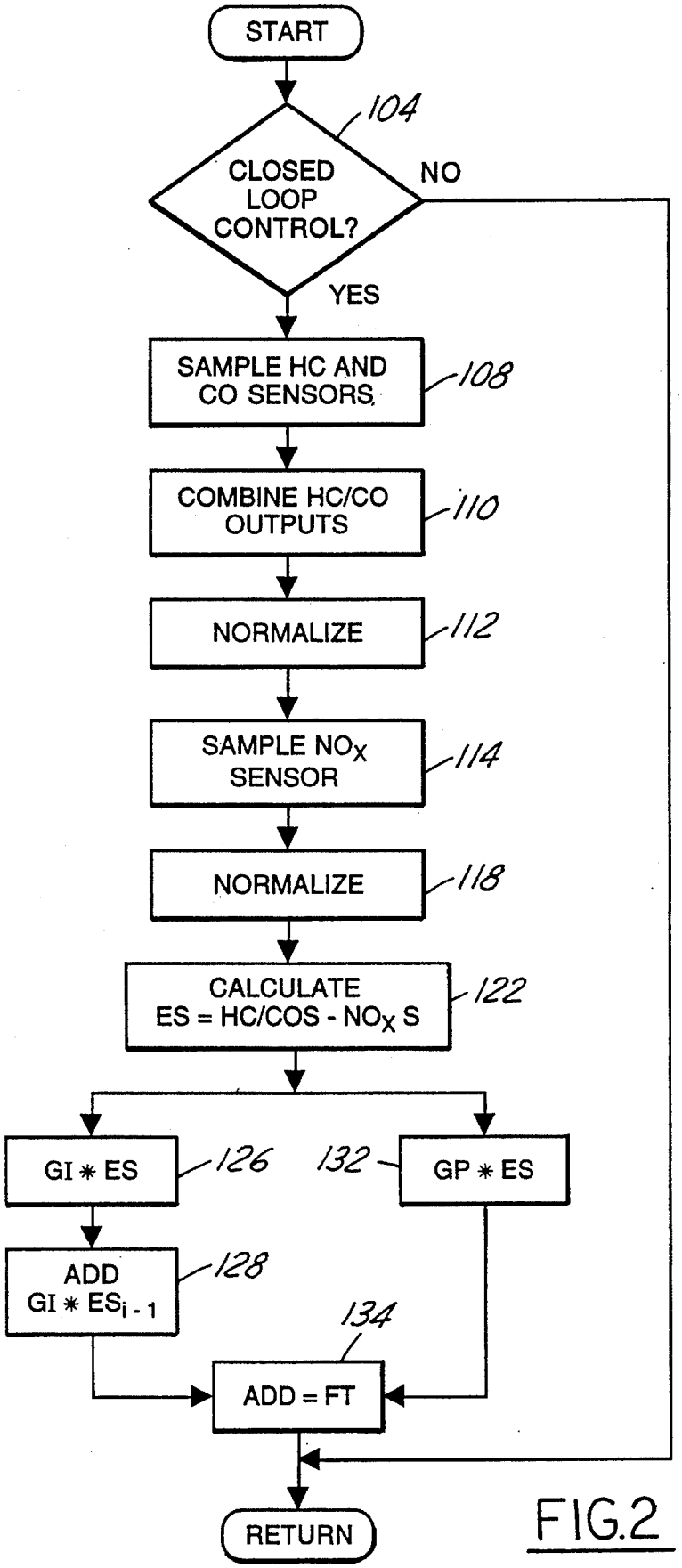
FIG. 2 is a flowchart of a subroutine executed by a portion of the embodiment shown in FIG. 1.

Referring now to FIG. 2, a flowchart of a routine performed by controller 8 to generate fuel trim signal FT is now described. A determination is first made whether closed-loop air/fuel control is to be commenced (step 104) by monitoring engine operating conditions such as temperature. When closed-loop control commences, sensors 52 and 54 are sampled (step 108) and their outputs shown combined in step 110. In this particular example, a single output signal related to the quantity of both HC and CO in the engine exhaust is thereby generated.

The HC/CO output signal is normalized with respect to engine speed and load during step 112. A graphical representation of this normalized output is presented in FIG. 3A. As described in greater detail later herein, the zero level of the normalized HC/CO output signal is correlated with the operating window, or point of maximum converter efficiency, of catalytic converter 50.

Continuing with FIG. 2, nitrogen oxides sensor 46 is sampled during step 114 and normalized with respect to engine speed and load during step 118. A graphical representation of the normalized output of nitrogen oxides sensor 46 is presented in FIG. 3B. The zero level of the normalized nitrogen oxide signal is correlated with the operating window of catalytic converter 50 resulting in maximum converter efficiency.

During step 122, the normalized output of nitrogen oxides sensor 46 is subtracted from the normalized HC/CO output signal to generate combined emissions signal ES. The zero crossing point of emission signal ES (see FIG. 3D) corresponds to the actual operating window for maximum converter efficiency of catalytic converter 50. As described below with reference to process steps 126 to 134, emission signal ES is processed in a proportional plus integral controller to generate fuel trim signal FT for trimming feedback variable FV which is generated as described later herein with respect to the flowchart shown in FIG. 4.

Referring first to step 126, emission signal ES is multiplied by gain constant GI and the resulting product added to the products previously accumulated ($GI * ES_{i-1}$) in step 128. Stated another way, emission signal ES is integrated each sample period (i) in steps determined by gain constant GI. During step 132, emission signal ES is also multiplied by proportional gain GP. The integral value from step 128 is added to the proportional value from step 132 during addition step 134 to generate fuel trim signal FT. In summary, the proportional plus integral control described in steps 126–134 generates fuel trim signal FT from emission signal ES.

The routine executed by microcomputer 10 to generate the desired quantity of liquid fuel delivered to engine 28 and trimming this desired fuel quantity by a feedback variable related both to EGO sensor 44 and fuel trim signal FT is now described with reference to FIG. 4. During step 158, an open-loop fuel quantity is first determined by dividing measurement of inducted mass airflow (MAF) by desired air/fuel ratio AFd which is typically the stoichiometric value for gasoline combustion. This open-loop fuel charge is then trimmed, in this example divided, by feedback variable FV.

After a determination that closed-loop control is desired (step 160) by monitoring engine operating conditions such as temperature, signal EGOS is read during step 162. During step 166, fuel trim signal FT is transferred from the routine previously described with reference to FIG. 2 and added to signal EGOS to generate trim signal TS.

During steps 170–178, a conventional proportional plus integral feedback routine is executed with trimmed signal TS as the input. Trimmed signal TS is first multiplied by integral gain value KI (see step 170) and this product is added to the previously accumulated products (see step 172). That is, trimmed signal TS is integrated in steps determined by gain constant KI each sample period (i). This integral value is added to the product of proportional gain KP times trimmed signal TS (see step 176) to generate feedback variable FV (see step 178). As previously described with reference to step 158, feedback variable FV trims the fuel delivered to engine 28. Feedback variable FV will correct the fuel delivered to engine 28 in a manner to drive emission signal ES to zero.

Figure 5:
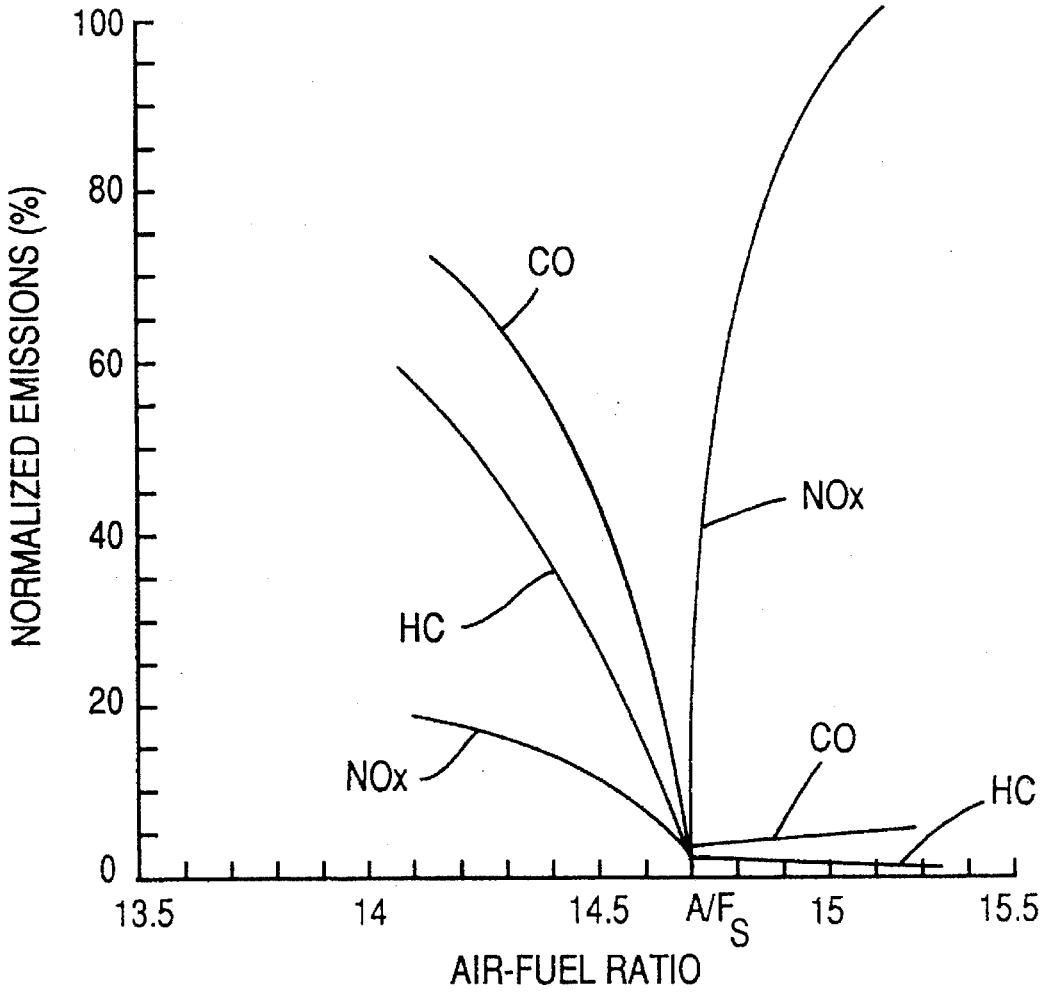
FIG. 5 is a graphical representation of various outputs of a portion of the embodiment shown in FIG. 1.

An example of operation for the above described air/fuel control system is shown graphically in FIG. 5. More specifically, measurements of HC, CO, and NOx emissions from catalytic converter 50 after being normalized over an engine speed load range are plotted as a function of air/fuel ratio. Maximum converter efficiency is shown when the air/fuel ratio is increasing in a lean direction, at the point when CO and HC emissions have fallen near zero, but before NOx emissions have begun to rise. Similarly, while the air/fuel ratio is decreasing, maximum converter efficiency is achieved when nitrogen oxide emissions have fallen near zero, but CO and HC emissions have not yet begun to rise.

In accordance with the above described operating system, the operating window of catalytic converter 50 will be maintained at the zero crossing point of emissions signal ES (see FIG. 3D) regardless of the reference air/fuel ratio selected and regardless of the switch point of EGO sensor 44.

An example of operation has been presented wherein emission signal ES is generated by subtracting the output of a nitrogen oxide sensor from a combined HC/CO output signal and thereafter fed into a proportional plus integral controller. The invention claimed herein, however, may be used to advantage with other than a proportional plus integral controller. The invention claimed herein may also be used to advantage with a combined HC and CO sensor or the use of either a CO or a HC sensor in conjunction with a nitrogen oxide sensor. And, the invention may be used to advantage by combining the sensor outputs by signal processing means other than simple subtraction.

The routine for measuring emissions of engine 28 while engine 28 is operating under air/fuel feedback control is now described with reference to the flowcharts shown in FIGS. 6A–6B. When engine coolant temperature T is less than reference value TREF (step 202), the outputs from this subroutine are stored in the cold-start tables shown schematically as a portion (blocks 302*a*–316*a*) of random access memory (RAM) 20 in FIG. 7. On the other hand, when engine temperature T is greater than reference value TREF (step 202), the outputs from this subroutine are stored in the warmed-up tables shown as a portion (blocks 302*b*–316*b*) of random access memory (RAM) 20 in FIG. 7.

Figure 6A:
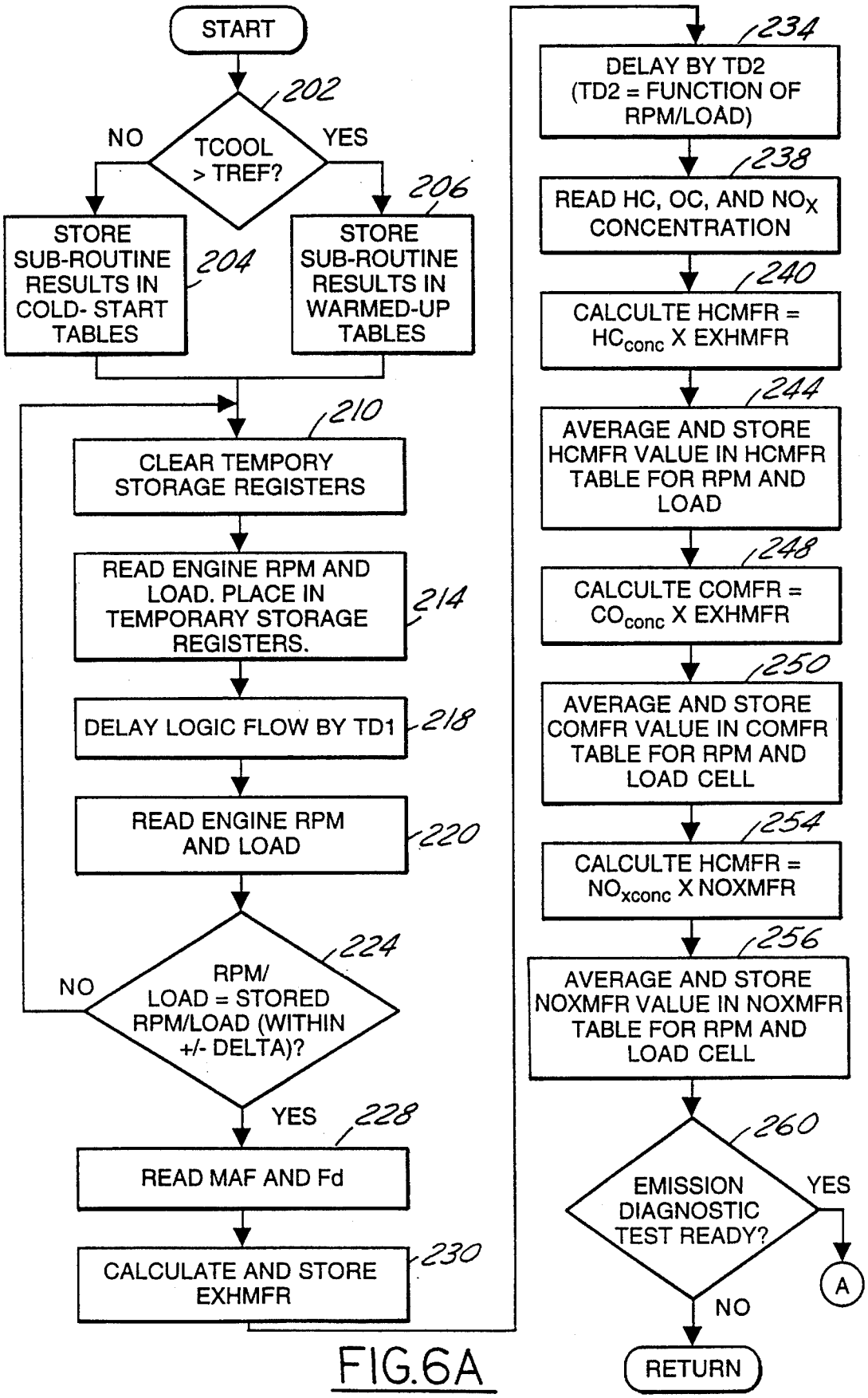
FIGS. 6A–6B are flowcharts of a subroutine executed by a portion of the embodiment shown in FIG. 1.
Figure 6B:
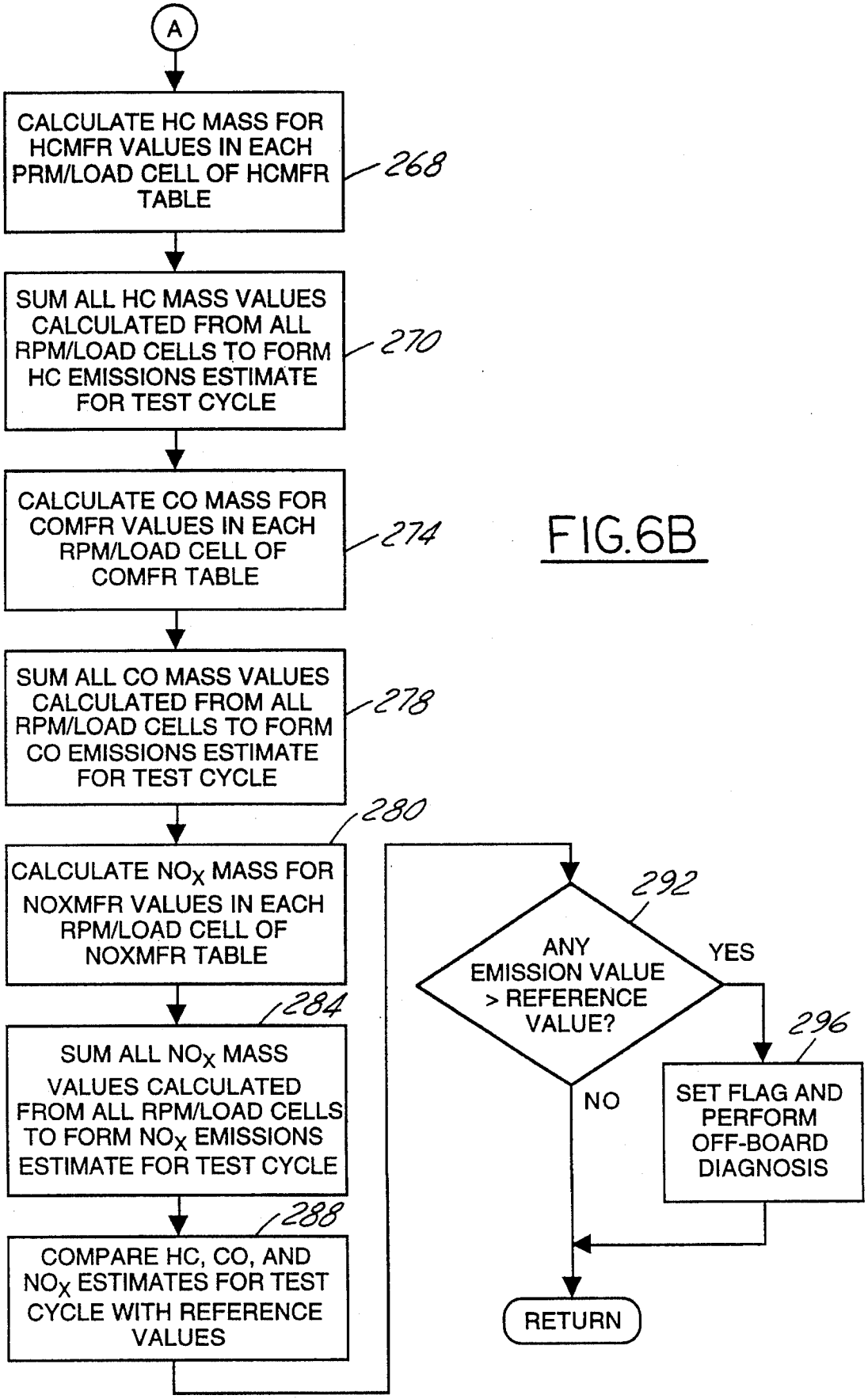
Figure 7:
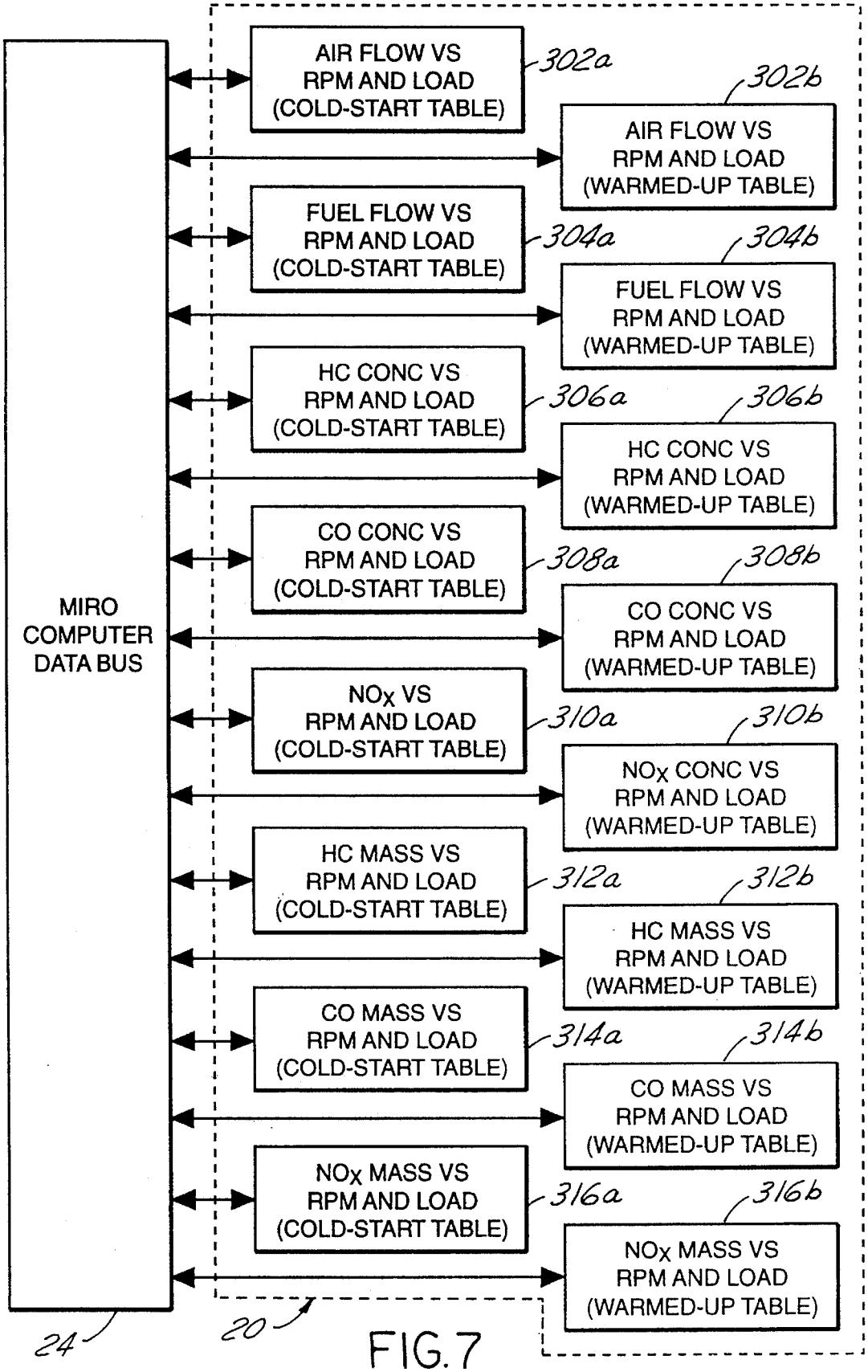
FIG. 7 is a flowchart of a subroutine executed by a portion of the embodiment shown in FIG. 1.

Continuing with FIGS. 6A–6B, after the appropriate cold-start or warmed-up tables are selected in steps 202, 204, and 206, temporary storage registers are cleared during step 210. Engine rpm and load (in this particular example manifold pressure MAP) are stored in temporary storage locations of random access memory (RAM) 20 of microcomputer 10 as shown in step 214. Further execution of this particular subroutine is then delayed by time TD1 as illustrated in step 218. After time delay TD1, engine rpm and load are again read during step 220, and compared to the previously stored engine rpm and load values during step 224. If the previously stored rpm and load values vary from the currently sampled rpm and load values by more than value delta, an indication is provided that a transient has occurred and the data storage registers are cleared (step 210) and the subroutine started again.

Figure 4:
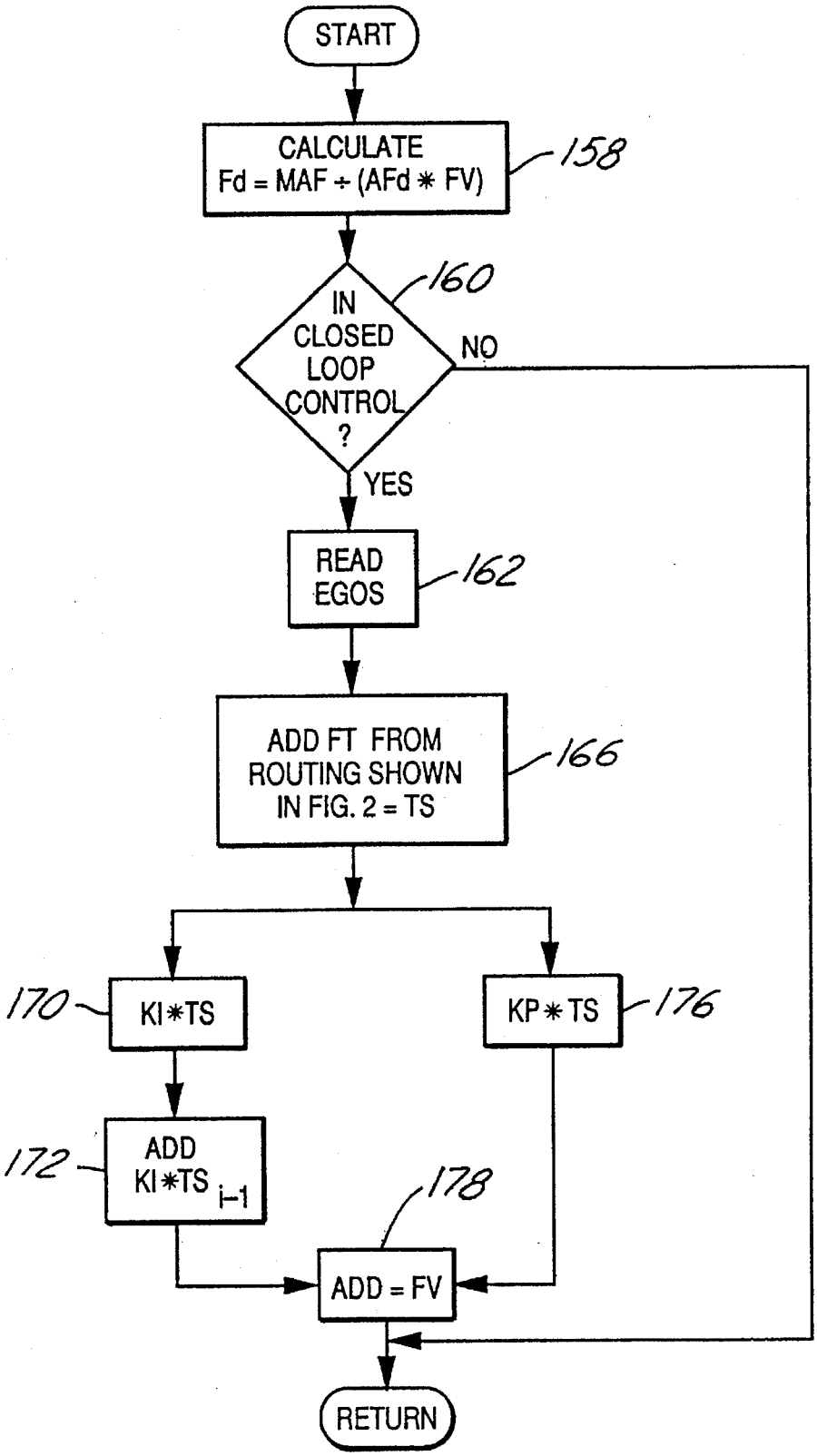
FIG. 4 is a flowchart of a subroutine executed by a portion of the embodiment shown in FIG. 1.

Inducted mass airflow (MAF) from sensor 32 and mass fuel flow Fd from the subroutine described with reference to FIG. 4 are read during step 228. Those skilled in the art will recognize that measurements of inducted mass airflow may be obtained by devices other than a mass airflow meter. For example, it is well-known to use a speed density algorithm and determine inducted mass airflow from manifold pressure (MAP) and engine speed (rpm). Further, inducted mass airflow may be obtained from a volume flow meter with conversion to mass units by conventional and well-known algorithms.

Exhaust mass flow rate (EXHMFR) is calculated from inducted mass airflow MAF and mass fuel flow Fd during step 230 and stored (step 230). Another time delay (TD2) is then introduced into the subroutine (step 234) as a function of engine speed and load and, thereafter, hydrocarbon (HC) concentration, carbon monoxide (CO) concentration, and nitrogen oxides ($NO_x$) concentration are read from respective sensors 54, 52, and 46 (step 238). The purpose of second time delay TD2 (step 234) is to approximately align the calculation of exhaust mass flow rate EXHMFR, and the engine speed rpm and load readings, with the occurrence of the emission measurements (HC, CO, and $NO_x$). Stated another way, time delay Td2 compensates for the delay of an air/fuel charge through engine 28 and its exhaust system to respective HC, CO, and $NO_x$ sensors 54, 52, and 46.

Continuing with FIG. 6B, hydrocarbon mass flow rate HCMFR is calculated from the product of exhaust mass flow rate EXHMFR times the hydrocarbon HC concentration reading (step 240). For the particular rpm and load cell or range in which engine 28 is operating during this portion of the subroutine shown in FIG. 6B, the current hydrocarbon mass flow rate calculation HCMFR is averaged with the previously averaged hydrocarbon mass flow rates HCMFR to generate a new average hydrocarbon mass flow rate HCMFR (see step 244).

Carbon monoxide mass flow rate COMFR is calculated from the product of exhaust mass flow rate EXHMFR and the reading of carbon monoxide concentration COconc (step 248). During this particular background loop of the subroutine shown in FIGS. 6A–6B, the current calculation of carbon monoxide mass flow rate COMFR is averaged with the previous average for the particular rpm and load cell in which engine 28 is operating during this current background loop of microprocessor 10 (step 250).

Nitrogen oxide mass flow rate NOXMFR is calculated from the product of exhaust mass flow rate EXHMFR and the reading of nitrogen oxides concentration NOxconc (step 254). Nitrogen oxides mass flow rate NOXMFR for this particular background loop is then averaged with the previously averaged nitrogen oxides mass flow rate valves for the rpm and speed load cell of engine 28 which were stored at the beginning of this subroutine (step 256).

After engine 28 has operated in all speed load cells required by this emission subroutine (step 260), the subroutine proceeds with a calculation of total mass emissions. More specifically, during step 268, hydrocarbon mass in each rpm/load cell are calculated by multiplying each stored hydrocarbon mass flow rate HCMFR by the time duration corresponding to a particular test cycle. The calculated hydrocarbon mass values from all the rpm/load cells are then summed to form HC mass emissions estimate for the test cycle (step 270). The subroutine proceeds in a similar manner to calculate the carbon monoxide mass emissions estimate for the test cycle (see steps 274 and step 278). Similarly, a total nitrogen oxides mass emissions estimate for the test cycle is calculated during step 280 and step 284.

Each total emissions mass estimate is then compared with a respective reference value during step 288, and the emissions set flag set if any total mass value exceeds a corresponding reference value (steps 292 and 296).

An example of operation has been presented wherein the total mass of nitrogen oxides, hydrocarbons, and carbon monoxide is calculated during a test cycle while the vehicle is being operated under actual driving conditions. Those skilled in the art will recognize that the invention described herein is applicable to additional by-products found in the engine exhaust. Other embodiments will be readily envisioned by those skilled in the art without departing from the spirit and scope of the invention claimed herein. Accordingly, it is intended that the invention be limited only by the following claims.

What is claimed:

1. An air/fuel control system for an engine having an exhaust coupled to a catalytic converter, comprising:

a first sensor positioned downstream of the converter for providing a first electrical signal related to concentration of nitrogen oxide in the exhaust;

a second sensor positioned downstream of the converter for providing a second electrical signal related to concentration of at least one exhaust by-product other than nitrogen oxides;

a fuel controller delivering fuel to the engine in relation to a feedback variable derived from said first and second electrical signals; and said fuel controller providing a measurement of engine emissions in response to a conversion of said first signal from concentration of nitrogen oxides to mass of nitrogen oxides emitted and a conversion of said second signal from concentration of said exhaust by-product to mass of said exhaust by-product emitted.

2. The air/fuel control system recited in claim 1 wherein said second sensor detects concentration of hydrocarbons.

3. The air/fuel control system recited in claim 1 wherein said second sensor detects concentration of carbon monoxide.

4. The air/fuel control system recited in claim 1 wherein said second sensor detects concentration of hydrocarbons and further comprising a third sensor positioned downstream of the converter providing a third signal related to concentration of carbon monoxide and wherein said fuel controller is also responsive to said third signal for providing said emissions measurement.

5. The air/fuel control system recited in claim 4 wherein said fuel controller is further responsive to said third signal for said fuel delivery.

6. The air/fuel control system recited in claim 1 further comprising means for providing a measurement of mass airflow inducted into the engine and wherein said fuel controller converts said first signal from an indication of nitrogen oxide concentration to mass of nitrogen oxide emitted in response to said mass airflow measurement.

7. The air/fuel control system recited in claim 2 further comprising means for providing an indication of airflow inducted into the engine and wherein said fuel controller converts said second signal from an indication of hydrocarbon concentration to mass of hydrocarbon emitted in response to said mass airflow measurement.

8. The air/fuel control system recited in claim 3 further comprising means for providing an indication of airflow inducted into the engine and wherein said fuel controller converts said third signal from an indication of carbon monoxide concentration to mass of carbon monoxide emitted in response to said mass airflow measurement.

9. The air/fuel control system recited in claim 6 wherein said fuel controller is further responsive to said mass airflow measurement for said fuel delivery.

10. The air/fuel control system recited in claim 6 wherein said controller provides said emission measurement during a test cycle generated when the engine has completed operation in a predetermined number of load ranges.

11. An engine air/fuel control method for controlling an engine coupled to a catalytic converter and for providing a measurement of engine emissions, comprising the steps of:

measuring nitrogen oxide concentration of exhaust gases downstream of the converter;

converting said nitrogen oxide concentration measurement to a measurement of mass of nitrogen oxide emitted to generate a first measurement signal;

measuring hydrocarbon concentration of exhaust gases downstream of the converter;

converting said hydrocarbon concentration measurement to a measurement of mass of hydrocarbon emitted to generate a second measurement signal; and correcting fuel delivered to the engine by a feedback variable derived from both said first measurement signal and said second measurement signal to maintain the engine air/fuel ratio at optimal converter efficiency and providing a measurement of emissions in response to said first measurement signal and said second measurement signal.

12. The method recited in claim 11 further comprising a step of measuring carbon monoxide concentration of exhaust gases downstream of the converter to generate a third measurement signal and wherein said step of providing a measurement of emissions is further responsive to said third measurement signal.

13. The method recited in claim 11 wherein said step of converting nitrogen concentration to mass is responsive to a measurement of mass airflow inducted into the engine.

14. The method recited in claim 11 wherein said step of measuring emissions further comprises a step of converting said second measurement signal to a measurement of carbon monoxide mass in the exhaust gases.

15. An engine air/fuel control method for controlling an engine coupled to a catalytic converter and for providing a measurement of engine emissions, comprising the steps of:

averaging samples of nitrogen oxide concentration measurements of exhaust gases downstream of the converter for each of a plurality of engine speed and load operating ranges;

averaging samples of hydrocarbon concentration measurements of exhaust gases downstream of the converter for each of a plurality of engine speed and load operating ranges.

converting said nitrogen oxide concentration averages to nitrogen oxide mass averages;

converting said hydrocarbon concentration averages to hydrocarbon mass averages; and correcting fuel delivered to the engine by a feedback variable derived from said nitrogen oxide measurements and said hydrocarbon measurements to maintain engine air/fuel ratio at optimal converter efficiency and providing a measurement of mass emissions in response to said nitrogen oxide mass averages and said hydrocarbon mass averages.

16. The method recited in claim 15 further comprising a step of determining mass airflow inducted into the engine and wherein said nitrogen oxide conversion step comprises a step of multiplying each of said nitrogen oxide concentration samples by both said mass airflow determination and a determination of fuel inducted into the engine.

17. The method recited in claim 16 wherein said hydrocarbon conversion step is responsive to said mass airflow determination.

18. The method recited in claim 16 wherein said fuel delivery correction step is responsive to said mass airflow determination.

19. The method recited in claim 16 further comprising a step of delaying said mass airflow determination to align said mass airflow determination in time with said nitrogen oxide samples.

20. The method recited in claim 15 further comprising the steps of averaging samples of carbon monoxide concentration measurements of exhaust gases downstream of the converter for each of a plurality of engine speed and load operating ranges and converting said carbon monoxide concentration averages to carbon monoxide mass averages and wherein said step of providing an indication of measuring mass emissions is responsive to said carbon monoxide mass averages.

* * * * *